US007546831B2

(12) United States Patent
Kaneko

(10) Patent No.: US 7,546,831 B2
(45) Date of Patent: Jun. 16, 2009

(54) FUEL INJECTION APPARATUS FOR ENGINES AND METHOD OF OPERATING THE ENGINE EQUIPPED WITH THE APPARATUS

(75) Inventor: Takashi Kaneko, Sagamihara (JP)

(73) Assignee: Mitsubishi Heavy Industries, Ltd., Kanagawa-Ken (JP)

( * ) Notice: Subject to any disclaimer, the term of this patent is extended or adjusted under 35 U.S.C. 154(b) by 0 days.

(21) Appl. No.: 11/822,019

(22) Filed: Jun. 29, 2007

(65) Prior Publication Data

US 2008/0127943 A1 Jun. 5, 2008

(30) Foreign Application Priority Data

Nov. 30, 2006 (JP) ..... 2006-324641

(51) Int. Cl.
*F02M 37/04* (2006.01)

(52) U.S. Cl. ..... 123/506; 123/446; 123/501

(58) Field of Classification Search ..... 123/506, 123/496, 446, 447, 500, 501
See application file for complete search history.

(56) References Cited

U.S. PATENT DOCUMENTS 4,643,155 A * 2/1987 O'Neill ..... 123/506
4,881,504 A * 11/1989 Best ..... 123/447
5,094,216 A * 3/1992 Miyaki et al. ..... 123/506
5,823,168 A * 10/1998 Otoh et al. ..... 123/496
6,016,790 A * 1/2000 Makino et al. ..... 123/496
6,311,674 B1 * 11/2001 Igashira et al. ..... 123/458
6,318,343 B1 * 11/2001 Nakagawa et al. ..... 123/500
6,546,917 B2 * 4/2003 Onishi et al. ..... 123/506
6,694,952 B1 * 2/2004 Yamazaki et al. ..... 123/496
7,121,263 B2 * 10/2006 Eser ..... 123/446

FOREIGN PATENT DOCUMENTS

JP 62-258160 A 11/1987
JP 64-73166 A 3/1989

* cited by examiner

*Primary Examiner*—Thomas N Moulis
(74) *Attorney, Agent, or Firm*—Birch, Stewart, Kolasch & Birch, LLP

(57) ABSTRACT

A fuel injection apparatus for engines is provided, with which occurrence of cavitation erosion on constituent parts of the high pressure fuel pump and fuel feed line to the pump in the apparatus is suppressed and high durability is attained even in the case of a high pressure fuel pump increased largely in capacity. Each of high pressure fuel pumps to supply high pressure fuel to a common rail comprises an electromagnetic valve which is controlled by a controller such that fuel is discharged from the plunger room by closing the electromagnetic valve in the up stroke of the plunger until the plunger reaches its top dead center, the electromagnetic valve is kept closed for some period in the down stroke of the plunger, then the electromagnetic valve is opened to allow the plunger room to be communicated with a fuel feed/spill passage.

6 Claims, 5 Drawing Sheets

FUEL INJECTION APPARATUS FOR ENGINES AND METHOD OF OPERATING THE ENGINE EQUIPPED WITH THE APPARATUS

BACKGROUND OF THE INVENTION

1. Field of the Invention

The present invention relates to a fuel injection apparatus and applied to a diesel engine, etc. equipped with an accumulator fuel injection apparatus, the apparatus being composed such that; high pressure fuel pumps are provided each of which compresses fuel introduced into its plunger room to high pressure by its plunger fitted in its plunger barrel and reciprocated by means of a fuel cam to supply the compressed fuel to a common rail, and high pressure fuel accumulated in the common rail is injected periodically at determined injection timing into each of the cylinders of the engine, and a method of operating the engine equipped with the apparatus.

2. Description of the Related Art

An accumulator fuel injection equipment used in a diesel engine is provided with high pressure fuel injection pumps each of which compresses fuel introduced into its plunger room to high pressure by its plunger fitted in its plunger barrel and reciprocated by means of a fuel cam, and high pressure fuel accumulated in the common rail is supplied to each of fuel injection valves to be injected periodically at determined injection timing into each engine cylinder.

In an accumulator fuel injection apparatus like this, discharge duration of high pressure fuel from each of the high pressure pumps is controlled by controlling opening/closing of a low pressure side fuel feed passage by means of an electromagnetic valve provided to each pump as disclosed for example in Japanese Laid-Open Patent Application No. 64-73166 (patent literature 1) and Japanese Laid-Open Patent Application No. 62-258160 (patent literature 2).

FIG. 2B represents a diagram showing a fuel cam lift and opening/closing of the electromagnetic valve vs. crankshaft rotation angles in the electronically-controlled accumulator fuel injection apparatus disclosed in the patent literature 1.

As shown in FIG. 2B, in the conventional electronic control accumulator fuel injection apparatus, the electromagnetic valve is closed on the way the cam lift is increasing to begin fuel discharge from the high pressure fuel pump, and opened when the cam lift is at its maximum to allow high pressure fuel remaining in the plunger room (volume of the plunger room is at minimum, i.e. dead volume) of the high pressure pump to spill out to the fuel feed line (low pressure side fuel line).

FIG. 5 is a drawing for explaining working of a high pressure fuel pump 020 in the conventional accumulator fuel injection apparatus. In the drawing, change of lift of fuel cam 04, open or close of inlet/spill port 010*a*, and direction of fuel flow at inlet/spill port 010*a* are shown as the fuel cam 04 is rotated.

In FIG. 5, at (A) (crankshaft rotation angle $\theta=\theta_0=0°$), the plunger 02 is at its bottom dead center (at zero lift of the fuel cam 04), the top end of the plunger 02 has fully opened the port 010*a*, and fuel fed from the fuel feed line has been introduced into the plunger room 03.

At (B) (crankshaft rotation angle $\theta=\theta_1$), the plunger 02 has moved up until a position where the top end of the plunger 02 fully closes the port 010*a*, and pressure feeding of fuel to the common rail begins. The fuel fed to the common rail is accumulated therein.

At (C) (crankshaft rotation angle $\theta=\theta_{21}$ and is before the top dead center of cam lift), the plunger 02 has moved up until a position where the leading edge 02*a* of the spill groove of the plunger 02 just begins to open the port 010*a*, and fuel in the plunger room 03 begins to spill out to the port 010*a*.

At (D) (crankshaft rotation angle $\theta=\theta_{22}$), the plunger 02 has passed over the top dead center and moved down until a position where the leading edge 02*a* of the spill groove of the plunger 02 fully closes the port 010*a*, and fuel spilling from the port 010*a* ceases.

At (E) (crankshaft rotation angle $\theta=\theta_3$), the plunger 02 has moved down until a position where the top end of the plunger 02 begins to open the port 010*a*, and fuel begins to enter the plunger room 03.

At (F) (crankshaft rotation angle $\theta=\theta_0$), the plunger 02 is again at the bottom dead center of cam lift, and the port 010*a* is fully opened by the top end of the plunger 02.

In prior art disclosed in the patent literature 1, the electromagnetic valve is closed on the way the cam lift is increasing to begin fuel discharge from the high pressure fuel pump, and opened when the cam lift is at its maximum to allow high pressure fuel remaining in the plunger room to spill to the fuel feed line.

Therefore, when the electromagnetic valve is opened at the top of the fuel cam lift, high pressure fuel remaining in the plunger room spills out from the plunger room to the fuel feed/spill passage of low pressure at high speed as shown in FIG. 2B.

In prior art disclosed in the patent literature 2, also high pressure fuel spilling occurs.

In an accumulation fuel injection apparatus of prior art in which the plunger has a spill groove, also spilling of high pressure fuel remaining in the plunger room occurs when the fuel inlet/spill port 010*a* is opened by the leading edge of the spill groove of the plunger, and high pressure fuel spills out rapidly at high speed through the inlet/spill port to the feed/spill passage as shown in FIG. 5.

SUMMARY OF THE INVENTION

The present invention was made in light of problems mentioned above, and the object of the present invention is to provide a fuel injection apparatus for engines, with which occurrence of cavitation erosion on constituent parts of the high pressure fuel pump and fuel feed line in the apparatus is suppressed and high durability is attained even in the case of a high pressure fuel pump increased largely in capacity.

To attain the object, the present invention proposes a fuel injection apparatus for engines, the apparatus comprising a plurality of high pressure fuel pumps in each of which fuel supplied to a plunger room is compressed by a plunger driven by a fuel cam to reciprocate in a plunger barrel, the compressed fuel is discharged to a common rail by at timing controlled by an electromagnetic valve, and high pressure fuel accumulated in the common rail is injected into engine cylinders by injection valves at controlled timing, wherein a controller is provided which controls such that fuel is discharged from the plunger room by closing the electromagnetic valve in an up stroke of the plunger, the electromagnetic valve is kept closed for some period in an down stroke of the plunger, then the electromagnetic valve is opened to allow the plunger room to be communicated with a fuel feed/spill passage.

The invention proposes a method of operating a fuel injection apparatus for engines, the apparatus comprising a plurality of high pressure fuel pumps, in each of which fuel supplied to a plunger room is compressed by a plunger driven by a fuel cam to reciprocate in a plunger barrel, the compressed fuel is discharged to a common rail at timing controlled by an electromagnetic valve, and high pressure fuel accumulated in the common rail is injected into engine cylinders by injection valves at controlled timing, wherein said high pressure fuel pump is controlled such that fuel is discharged from the plunger room by closing the electromagnetic valve in an up stroke of the plunger, the electromagnetic valve is kept closed for some period in a down stroke of the plunger, then the electromagnetic valve is opened to allow the plunger room to be communicated with a fuel feed/spill passage.

According to the invention, fuel is discharged from the plunger room in an up stroke of the plunger until the plunger reaches its top dead center by closing the inlet passage by the electromagnetic valve, the electromagnetic valve is kept closed in a down stroke of the plunger during a certain period of crankshaft rotation, then the electromagnetic valve is opened to allow the plunger room to be communicated with the fuel feed/spill passage, so the plunger room is communicated with the fuel feed/spill passage when fuel pressure in the plunger room has lowered to a pressure level in the fuel feed/spill passage or lower.

Therefore, a phenomenon of rapid back flow of high pressure fuel from the plunger room toward the fuel feed/spill passage at high speed, i.e. spilling of high pressure fuel, upon opening the electromagnetic valve, can be evaded, which occurs in the case of the conventional apparatus.

Accordingly, as occurrence of breakaway of flow and formation of eddies when high pressure fuel back flows from the plunger room to the fuel feed/spill passage when the inlet passage is opened can be evaded, occurrence of cavitation erosion around the fuel feed/spill passage and constituent parts of the fuel feed passage can be prevented, and high durability can be attained even in the case of a high pressure fuel pump increased largely in capacity.

Further, as the plunger room is communicated with the feed/spill passage after pressure in the plunger room has decreased to a level equal to or lower than that in the fuel feed/spill passage, pressure pulsation in the fuel feed/spill passage does not occur, and problems such as fuel leak and so on due to pressure pulsation does not occur.

Furthermore, as the plunger moves down from its top dead center while keeping the fuel feed/spill passage closed by the electromagnetic valve, the plunger moves down receiving pressure in the plunger room, so a part of energy used to drive the high pressure pump can be recovered.

Furthermore, as high pressure fuel does not spill through the inlet passage opened by the electromagnetic valve to the fuel feed passage connecting to the fuel feed pump, and it is not necessary as is in the case of the conventional high pressure pump to send spilled fuel again to the plunger room, so the fuel feed pump for supplying fuel to the plunger room can be small sized, and energy required to drive the fuel feed pump can be reduced as compared with the apparatus of prior art.

Therefore, energy efficiency of the fuel injection apparatus is increased.

It is preferable that a common rail pressure sensor is provided for detecting pressure in the common rail, and said controller is composed to retard opening time of said electromagnetic valve in the down stroke of the plunger as pressure in the common rail increases, based on the detected pressure.

By allowing the controller to control like this, opening time of the fuel feed/spill passage is retarded when pressure in the common rail is high so that the electromagnetic valve allows the fuel feed/spill passage to be opened when pressure in the plunger room becomes a pressure equal to or lower than that in the fuel feed/spill passage. Therefore, pressure in the plunger room does not exceed pressure in the fuel feed/spill passage when the electromagnetic valve is opened, and spilling out of high pressure fuel in the plunger room to the fuel feed/spill passage can be evaded. As a matter off course, it is suitable to detect directly discharge pressure of the high pressure fuel pumps to control timing of opening of the electromagnetic valves.

Further, the present invention proposes a fuel injection apparatus for engines, the apparatus comprising a plurality of high pressure fuel pumps, in each of which fuel supplied to a plunger room is compressed by a plunger driven by a fuel cam to reciprocate in a plunger barrel, the compressed fuel is discharged to a common rail at timing controlled by an electromagnetic valve, and high pressure fuel accumulated in the common rail is injected into engine cylinders by injection valves at controlled timing, wherein said plunger has a lead edge by which an inlet/spill port of the plunger barrel is closed in an up stroke of the plunger to allow fuel in the plunger room to be discharged until the plunger reaches its top dead center and is opened in a down stroke of the plunger to allow the plunger room to be communicated with a fuel feed/spill passage.

In the invention, it is preferable to compose concretively such that there are provided rack-pinion mechanism for rotating the plungers by sliding the rack, a rack drive device for sliding the rack, a common rail pressure sensor for detecting pressure in the common rail and inputting the detected pressure to said rack drive device, and a controller to allow the rack drive device to slide the rack to rotate the plungers based on the detected pressure so that timing of opening of the inlet/spill port by each of the plungers in down-stroke thereof is retarded as pressure in the common rail increases.

According to the invention, the plunger of the high pressure fuel pump is formed to have a lead edge, by which the inlet/spill port of the plunger barrel is closed in the up stroke of the plunger driven by the fuel cam to reciprocate in the plunger barrel to discharge fuel from the plunger room to the common rail and the inlet/spill port is opened in the down stroke of the plunger to allow the plunger room to be communicated with the fuel feed/spill passage, and timing of opening and closing of the inlet/spill port by the lead edge of the plunger can be varied by rotating the plunger by means of the rack-pinion mechanism.

The discharge of fuel ends at the top dead center of the plunger with the inlet/spill port being closed, and the inlet/spill port remains closed in the down stroke of the plunger from the top dead center for a certain period of crankshaft rotation until the plunger moves down to a position at which the inlet/spill port begins to be opened by the lead edge of the plunger to be communicated with the fuel feed/spill passage, so the plunger room is communicated with the fuel feed/spill passage in a state pressure in the plunger room is reduced to lower than that in the fuel feed/spill passage. Therefore, occurrence of spill of high pressure fuel in the plunger room through the inlet/spill port at high speed, which occurs in an apparatus of prior art, can be evaded.

As a result, occurrence of cavitation erosion at the inlet/spill port and in the fuel feed passage of the high pressure pump can be prevented and high durability can be attained even in the case of a high pressure fuel pump increased largely in capacity.

Further, as the plunger room is communicated with the fuel feed/spill passage in a state pressure in the plunger room is reduced to lower than that in the fuel feed/spill passage, pressure pulsation in the fuel feed/spill passage due to back flow of high pressure fuel through the inlet/spill ports to the fuel feed/spill passage does not occur, and problems such as fuel leak and so on due to pressure pulsation does not occur.

Furthermore, as the plunger moves down from its top dead center while the inlet/spill port remains closed, the plunger moves down receiving pressure in the plunger room, so a part of energy used to drive the high pressure pump can be recovered.

Furthermore, as high pressure fuel does not spill through the inlet/spill port to the fuel feed passage connecting to the fuel feed pump when the port is opened by the leading edge of the plunger, and it is not necessary as is in the case of the conventional high pressure pump to send spilled fuel again to the plunger room, so the fuel feed pump for supplying fuel to the plunger room can be small sized, and energy required to drive the fuel feed pump can be reduced as compared with the apparatus of prior art.

Therefore, energy efficiency of the fuel injection apparatus is increased.

DETAILED DESCRIPTION OF THE PREFERRED EMBODIMENTS

Preferred embodiments of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

The First Embodiment

Figure 1:
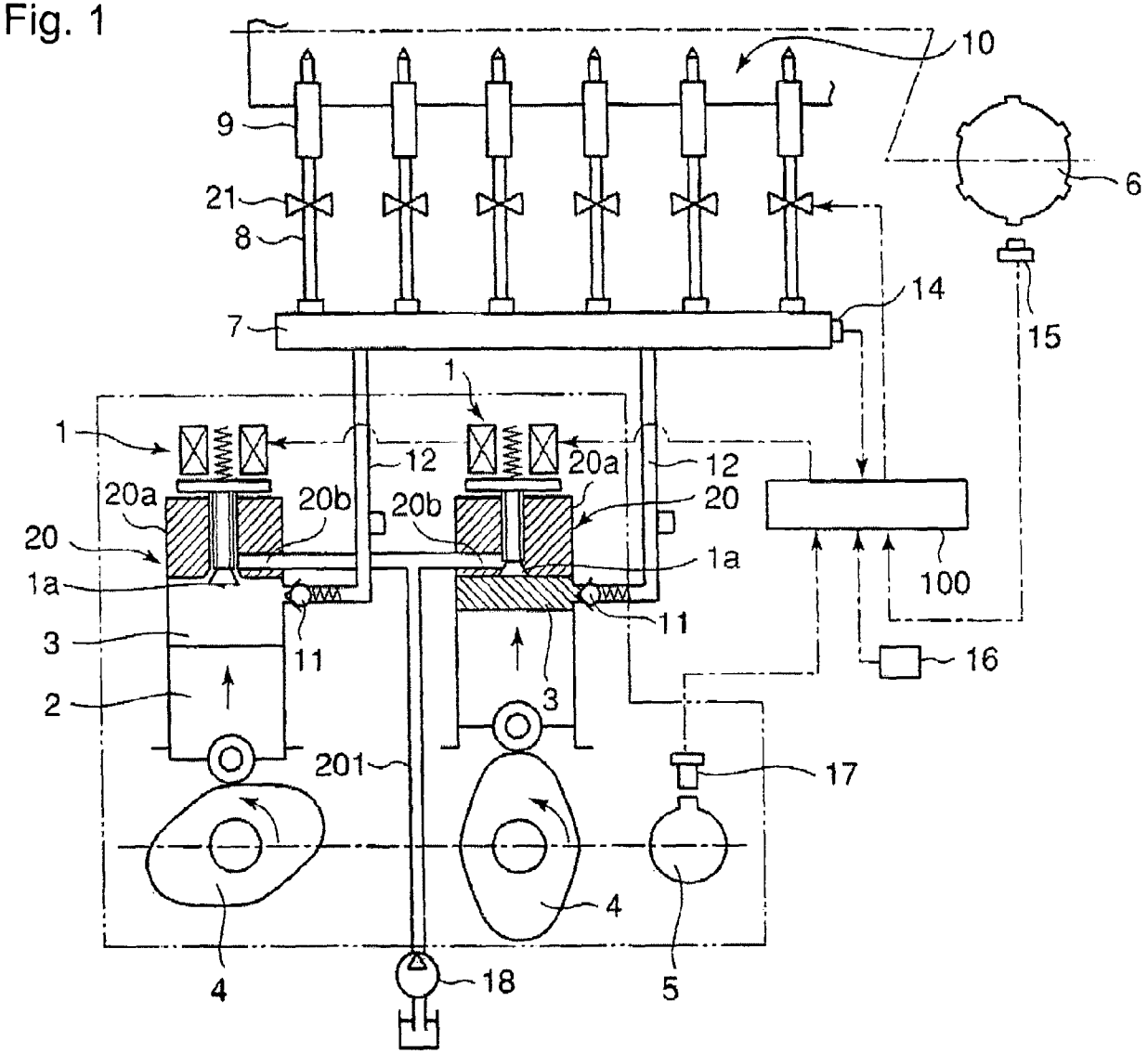
FIG. 1 is schematic representation of over-all configuration of a first embodiment of the electronically-controlled accumulation fuel injection apparatus for a diesel engine according to the invention.

FIG. 1 is schematic representation of over-all configuration of a first embodiment of the electronically-controlled accumulation fuel injection apparatus for a diesel engine according to the invention.

Referring to FIG. 1, a plurality of high pressure pumps 20 (two pumps in this example) are provided. Each of the high pressure pumps 20 has a plunger barrel 20*a* and a plunger 2 fitted in the plunger barrel 20*a* for reciprocation. Each of the plungers 2 is driven to reciprocate in each of the plunger barrels 20*a* by a fuel cam 4 formed on a camshaft 5 to correspond to each of the pumps 20, and compresses fuel supplied to each of plunger rooms 3.

A discharge pipe 12 of each of the high pressure pumps 20 connects each of the plunger rooms 3 to a common rail 7. A check valve 11 is provided at the outlet of each plunger room 3 to the discharge pipe 12 so that fuel can flow only in direction from the plunger rooms 3 to the common rail 7.

Fuel is supplied to the plunger rooms 3 by means of a fuel feed pump 18 via a fuel feed pipe 201 and each of fuel inlet passages 20*b* provided to each of the plunger barrels 20*a*. Each of the fuel inlet passages 20*b* is opened or closed by a poppet valve 1*a* of each of electromagnetic valves 1.

The fuel supplied to the common rail 7 from the high pressure pumps 20 through the discharge pipes 12 and accumulated in the common rail 7, is supplied to each of fuel injection valves 9 provided for each engine cylinder 10 through each injection pipe 8. The fuel is injected from the injection valve 9 into the engine cylinder 10. Fuel injection timing and quantity of each injection valve are controlled by each of fuel control valves 21 which are controlled by a controller 100.

The controller 100 receives a rotation angles of the crankshaft 6 detected by a crank angle sensor 15, engine loads detected by an engine load detector 16, and common rail pressure (fuel pressure in the common rail 7) detected by a common rail pressure detector 14.

The controller 100 outputs a control signal to control timing of opening and closing of the electromagnetic valve 1 of each of the high pressure pumps 20 based on the detected values. The controller 100 has also a function of adjusting fuel injection timing and quantity of the injection valves 9 by controlling the fuel control valves 21 based on the detected values.

In operation of a diesel engine equipped with the accumulation fuel injection apparatus constructed as mentioned above, fuel supplied by the fuel feed pump 18 through the fuel feed pipe 201 is allowed to enter the plunger room 3 through the fuel inlet passage 20*b* during a period the inlet passage 20*b* is opened by the poppet valve 1*a* of the electromagnetic valve 1 which is actuated by a command signal from the controller 100.

When the inlet passage 20*b* is closed by the poppet valve 1*a* of the electromagnetic valve 1 by a command signal from the controller 100, fuel in the plunger room 3 is compressed by moving up of the plunger 2 driven by the fuel cam 4 as shown in the right side pump in FIG. 1, and supplied to the common rail 7 passing through the check valve 11 and the discharge pipe 12 to be accumulated in the common rail 7.

High pressure fuel accumulated in the common rail 7 is injected from the fuel injection valve 9 into each engine cylinder 10 at controlled injection timing.

The present invention relates to controlling of high pressure fuel pumps 20 of a fuel injection apparatus composed as mentioned above.

Figure 2:
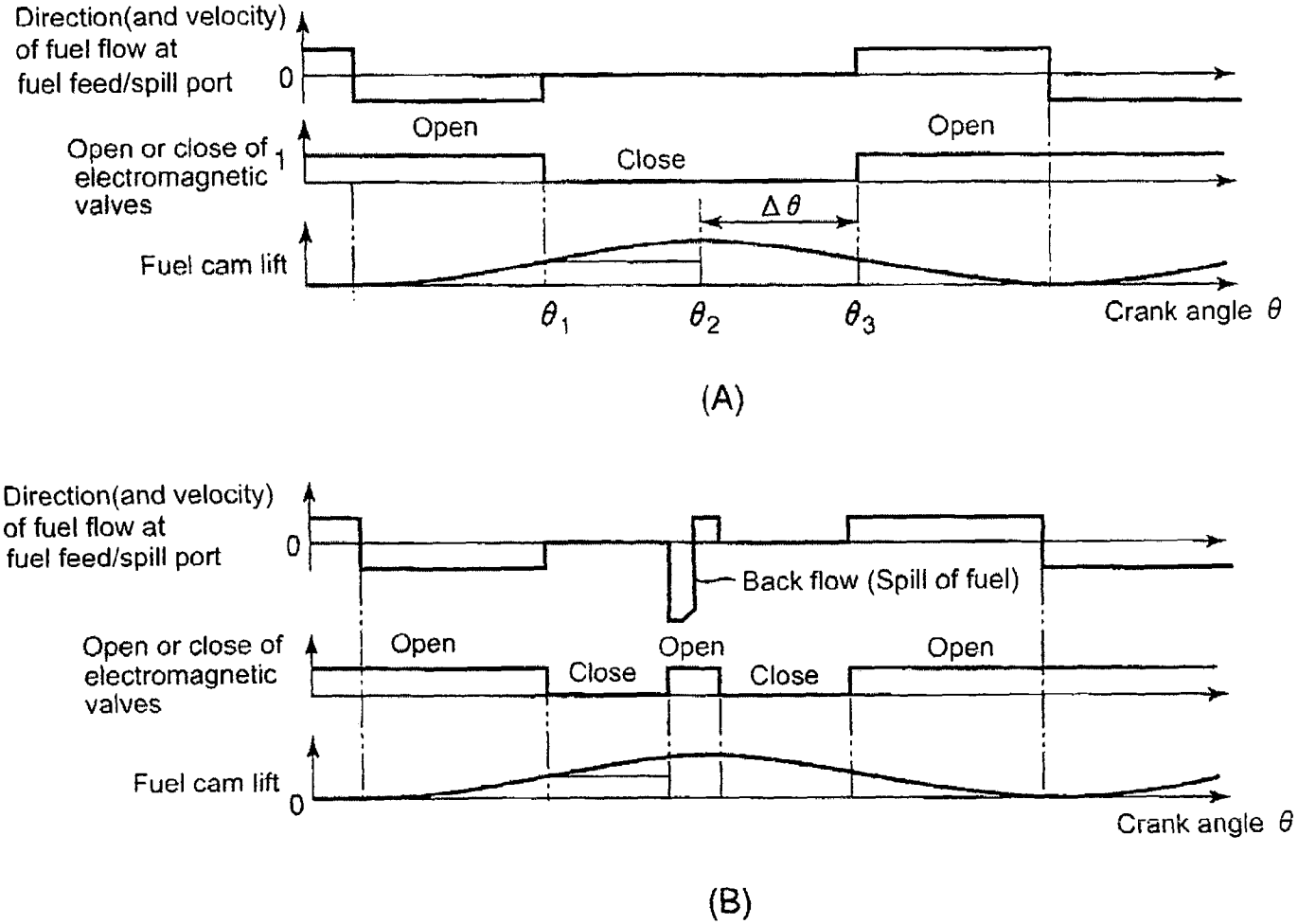
FIG. 2A is a diagram showing fuel cam lift, opening/closing of the electromagnetic valve, and state of fuel spilling from the plunger room through the inlet/spill port of the plunger barrel vs. crankshaft rotation angles in the case of the first embodiment of the invention.
FIG. 2B is a drawing as in FIG. 2A in the case of an apparatus of prior art.

FIG. 2A is a diagram showing fuel cam lift, opening/closing of the electromagnetic valve, and state of fuel spilling from the plunger room through the inlet/spill port of the plunger barrel vs. crankshaft rotation angles in the case of the first embodiment of the invention, and FIG. 2B is a drawing as in FIG. 2A in the case of an apparatus of prior art.

In the first embodiment of the invention, the controller 100 controls timing of opening and closing of the electromagnetic valve 1, as shown in FIG. 2A, such that; the inlet passage 20*b* is closed at crank angle $\theta_1$ while the plunger 2 is moving up driven by the fuel cam 4 in order to supply fuel to the common rail 7 through the discharge pipe 12, the inlet passage 20*b* is retained open until at crank angle $\theta_3$ in a down stroke of the plunger 2, the crank angle $\theta_3$ being a crankshaft rotation angle when the crankshaft rotated by $\Delta\theta$ from $\theta_2$ at which the plunger 2 is at the top dead center of the cam lift, then the inlet passage 20*b* is opened at crank angle $\theta_3$ in order to communicate the plunger room 3 to the fuel feed pipe 201 through the inlet passage 20*b*.

According to the first embodiment, fuel is discharged from the plunger room 3 in an up stroke of the plunger 2 until the plunger 2 reaches its top dead center at crank angle $\theta_2$ by closing the inlet passage 20*b*, the inlet passage 20*b* is kept closed in a down stroke of the plunger 2 during crankshaft rotation of a crank angle of $\Delta\theta$ until at crank angle $\theta_3$, at which the inlet passage 20*b* is opened and the plunger room 3 is communicated to the fuel feed pipe 201 via the poppet valve 1*a* of the electromagnetic valve 1, so the plunger room 3 is communicated to the fuel feed pipe 201 when fuel pressure in the plunger room 3 has lowered to a pressure level equal to or lower than that in the fuel feed pipe 201. Therefore, a phenomenon of rapid back flow of high pressure fuel from the plunger room 3 toward a low pressure side such as the fuel feed pipe 201 at high speed, i.e. spilling of high pressure fuel, upon opening the inlet passage 20*b* can be evaded, which occurs in the case of the conventional apparatus.

Accordingly, as occurrence of breakaway of flow and formation of eddies when high pressure fuel backflows from the plunger room to the low pressure side when the inlet passage 20*b* is opened, can be evaded, occurrence of cavitation erosion in parts around the inlet port of the plunger and inlet passage can be prevented, and high durability can be attained even in the case of a high pressure fuel pump increased largely in capacity.

Further, as the plunger room 3 is communicated to the feed pipe 201 after pressure in the plunger room has decreased to a level equal to or lower than that in the fuel feed pipe 201, pressure pulsation in the fuel feed passage does not occur, and problems such as fuel leak and so on due to a pressure pulsation does not occur.

Furthermore, as the plunger 2 moves down from its top dead center while keeping the electromagnetic valve 1 closed, the plunger 2 moves down receiving pressure in the plunger room, so a part of energy used to drive the high pressure pump can be recovered.

Furthermore, as high pressure fuel does not spill through the inlet passage 20*b* opened by the electromagnetic valve 1 to the fuel feed passage connecting to the fuel feed pump, and it is not necessary as is in the case of the conventional high pressure pump to send spilled fuel again to the plunger room, so the fuel feed pump 18 for supplying fuel to the plunger room 3 can be small sized, and energy required to drive the fuel feed pump 18 can be reduced as compared with the apparatus of prior art.

In the first embodiment, a common rail pressure sensor 14 is provided to detect pressure in the common rail 7 and input it in the controller 100, and the controller 100 controls the electromagnetic valve 1 so that the higher the pressure in the common rail 7, the later the inlet passage 20*b* opens.

By controlling like this, opening time of the inlet passage 20*b* is retarded when pressure in the common rail 7 is high so that the electromagnetic valve 1 allows the inlet passage 20*b* to open when pressure in the plunger room 3 becomes a pressure equal to or lower than that in the fuel feed pipe 201. Therefore, pressure in the plunger room 3 does not exceed pressure in the fuel feed pipe 201 when the inlet passage 20*b* is opened, and spilling out of high pressure fuel in the plunger room 3 through the inlet passage 20*b* to the fuel feed pipe 201 can be evaded.

The Second Embodiment

Figure 3:
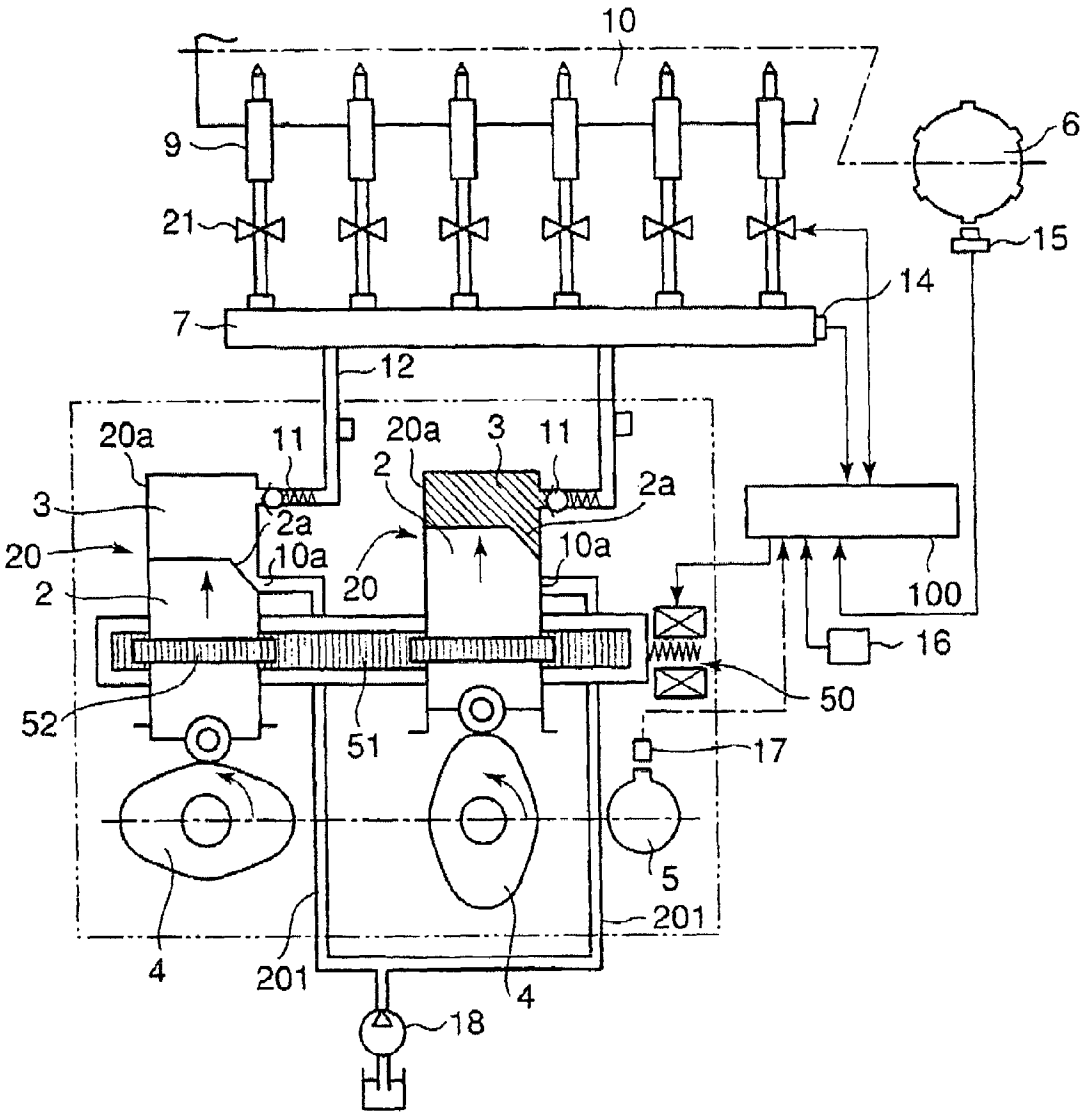
FIG. 3 is schematic representation of over-all configuration of a second embodiment of the electronically-controlled accumulation fuel injection apparatus for a diesel engine according to the invention.

FIG. 3 is schematic representation of over-all configuration of a second embodiment of the electronically-controlled accumulation fuel injection apparatus for a diesel engine according to the invention.

In the second embodiment, a plunger having a leading edge that enables the high pressure pump to function similar to that of the first embodiment is provided instead of the electromagnetic valve in the first embodiment.

Referring to FIG. 3, a plurality of high pressure pumps 20 (two pumps in this example) are provided. Each of the high pressure pumps 20 has a plunger barrel 20*a* in which a plunger 2 having a leading edge 2*a* is fitted for reciprocation. Each of the plungers 2 is driven to reciprocate in each of the plunger barrels 20*a* by a fuel cam 4 formed on a camshaft 5 to correspond to each of the pumps 20, and compresses fuel supplied to each of plunger rooms 3.

A discharge pipe 12 of each of the high pressure pumps 20 connects each of the plunger rooms 3 to a common rail 7. A check valve 11 is provided at the outlet of the plunger room to the discharge pipe so that fuel can flow only from the plunger room 3 to the common rail 7.

Fuel is supplied to the plunger rooms 3 by means of a fuel feed pump 18 via a fuel feed pipe 201. A fuel inlet/spill port 10*a* communicating to the fuel feed pipe 201 is opened and closed by the leading edge 2*a* of the plunger 2 formed at the top part thereof as the plunger reciprocates in the plunger barrel 20*a*.

The fuel supplied to the common rail 7 from the high pressure pumps 20 through the discharge pipes 12 and accumulated in the common rail 7, is supplied to each of fuel injection valves 9 provided for each engine cylinder 10 through each injection pipe 8. The fuel is injected from the injection valve 9 into the engine cylinder. Fuel injection timing and quantity of each injection valve 9 are controlled by each of fuel control valves 21 which are controlled by a controller 100.

The plungers 2 can be rotated by combination of pinions 52 and a rack 51. FIG. 3 is represented only to show that each of the plungers 2 can be rotated by sliding the rack 51, actual mechanism of rotating the plungers 2 is similar to that of a so-called in-line fuel injection pump widely known. Timing of opening and closing of the inlet/spill port 10*a* by the lead edge 2*a* of the plunger 2 can be varied by rotating the plunger 2.

An end of the rack 51 is connected to a rack drive device 50 of position controlling solenoid type. The rack drive device 50 controls rotation of the plunger 2 by controlling the slide position of the rack 51.

The controller 100 receives rotation angles of the crankshaft 6 detected by a crank angle sensor 15, engine loads detected by an engine load detector 16, and common rail pressure (fuel pressure in the common rail 7) detected by a common rail pressure detector 14.

The controller 100 allows the rack drive device 50 to slide the rack 51 based on the detected values so that rotation position of the plungers 2 is controlled based on the detected values.

The controller 100 has also a function of adjusting fuel injection timing and quantity of the injection valves 9 by controlling the fuel control valves 21 based on the detected values.

Figure 4:
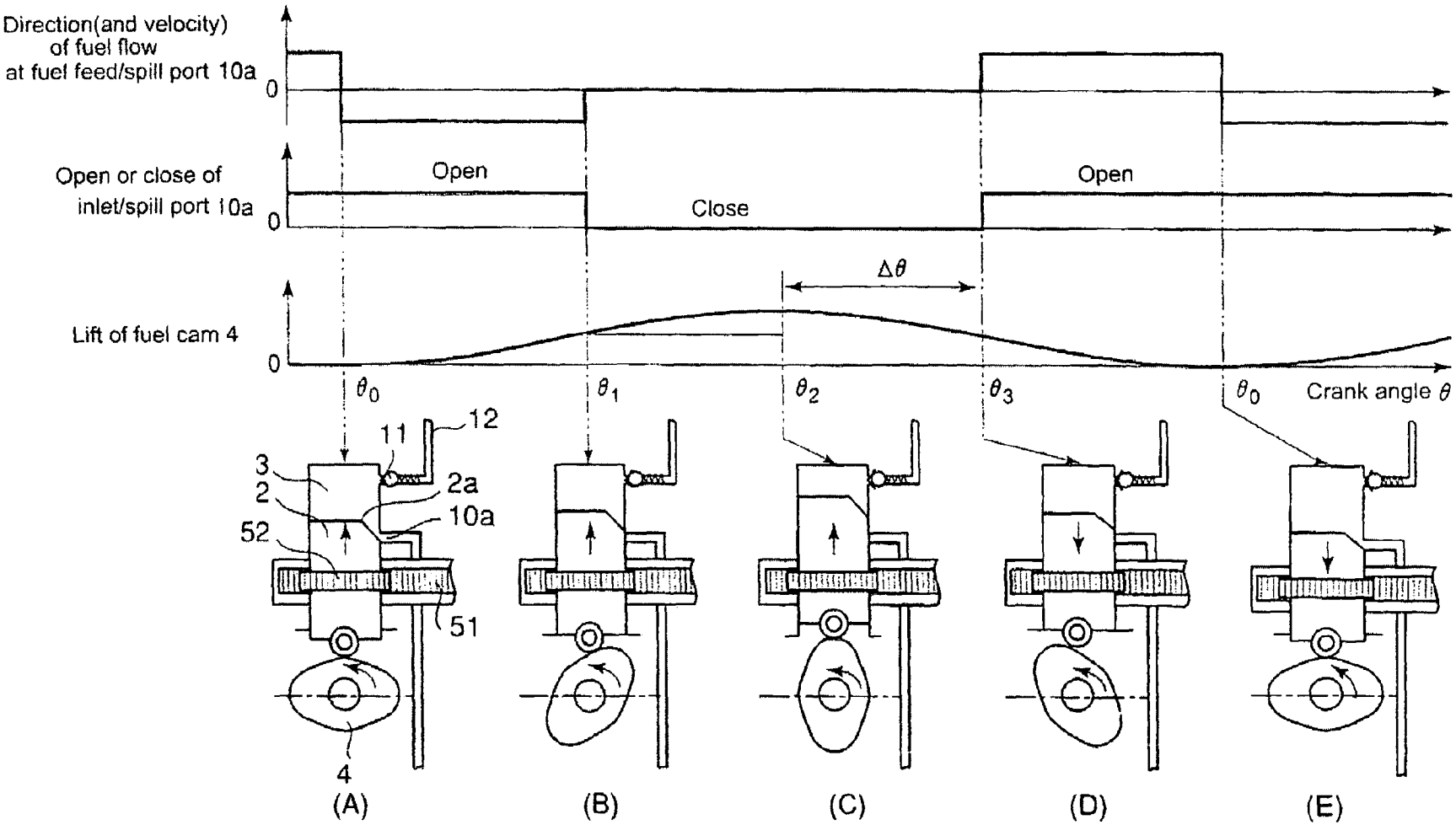
FIG. 4 is a drawing for explaining working of a high pressure fuel pump in the second embodiment.

FIG. 4 is a drawing for explaining working of the high pressure fuel pump 20 in the accumulation fuel injection apparatus of the second embodiment. In the drawing, a lift curve of the fuel cam 4, open or close of the inlet/spill port 10*a*, and direction of fuel flow at the inlet/spill port 10*a* vs. crankshaft rotation angle are shown.

In FIG. 4, at (A) (crankshaft rotation angle $\theta=\theta_0=0°$), the plunger 2 is at its bottom dead center (at zero lift of the fuel cam 4), the lead edge 2*a* of the plunger 2 has fully opened the inlet/spill port 10*a*, and fuel fed by the fuel feed pump 18 through the fuel feed pipe 201 is being introduced through the port 10*a* into the plunger room 3.

At (B) (crankshaft rotation angle $\theta=\theta_1$), the plunger 2 has moved up until a position where the lead edge of the plunger 2 fully closes the port 10*a*, and pressure feeding of fuel to the common rail 7 begins. The fuel fed to the common rail 7 is accumulated therein. Fuel accumulated in the common rail 7 is injected by fuel injection valves 9 into each of engine cylinders 10 at controlled injection timing.

At (C) (crankshaft rotation angle $\theta=\theta_2$), the plunger 2 is at its top dead center (at maximum lift of the fuel cam 4), and amounts of fuel discharged from the plunger room 3 to be supplied to the common rail 7 has reached a maximum.

The port 10*a* remains closed during the crankshaft rotates further by a crank angle of $\Delta\theta$ until the plunger 2 moves down to a position at which the port 10*a* begins to be opened by the lead edge 2*a* of the plunger 2, as shown in (D).

At (D) (crankshaft rotation angle $\theta=\theta_3$), the port 10*a* begins to be opened as mentioned above.

At (E) (crankshaft rotation angle $\theta=\theta_0$), the plunger 2 is again at its bottom dead center, and the port 10*a* is fully opened by the lead edge 2*a* of the plunger 2.

Figure 5:
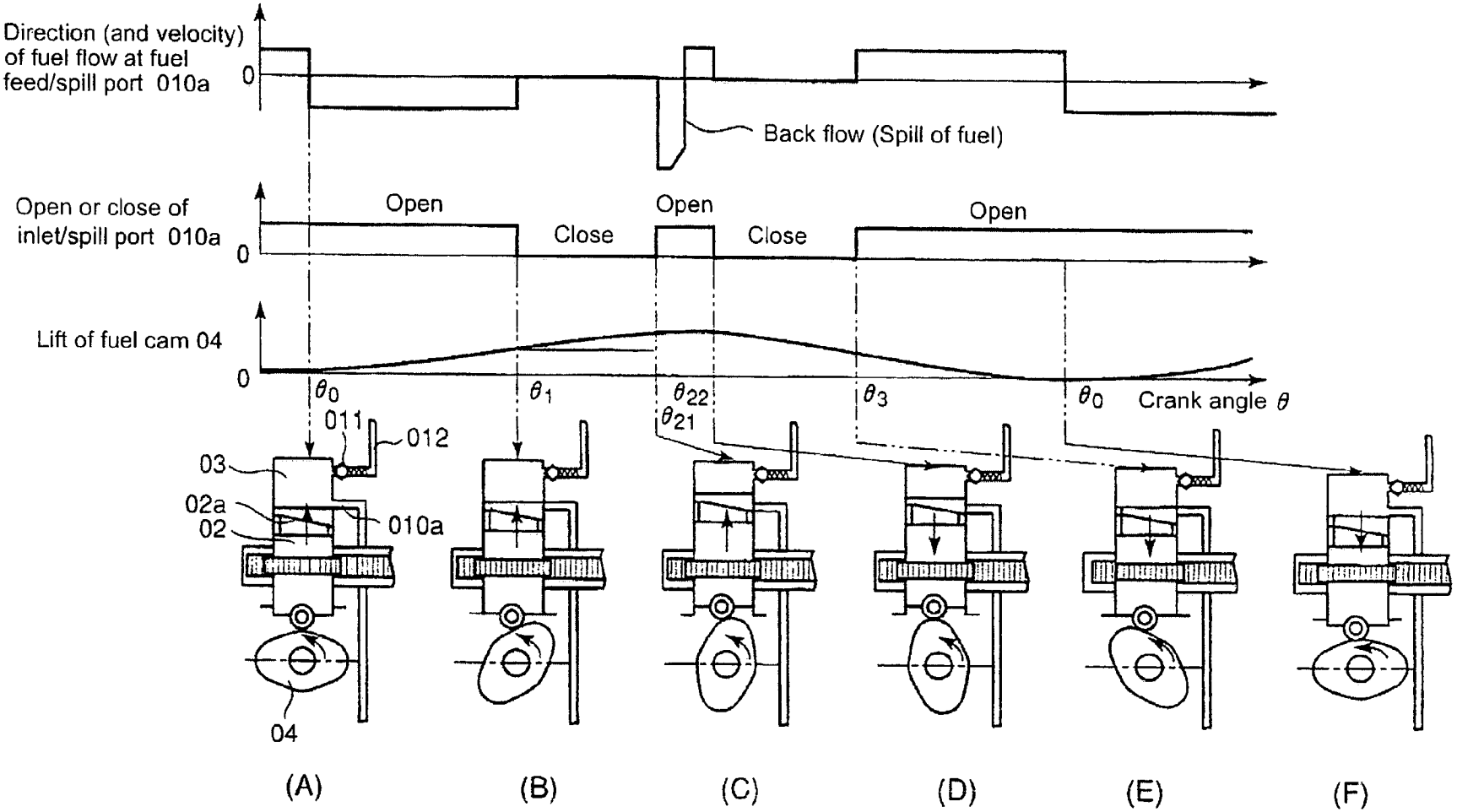
FIG. 5 is a drawing for explaining working of a high pressure fuel pump in the conventional accumulator fuel injection apparatus.

According to the second embodiment, the plunger 2 of the high pressure fuel pump 20 is formed to have the lead edge 2*a*, by which the inlet/spill port 10*a* is closed in the up stroke of the plunger 2 driven by the fuel cam 4 to reciprocate in the plunger barrel 20*a* to discharge fuel from the plunger room 3 to the common rail 7 and the port 10*a* is opened in the down stroke of the plunger 2 to allow the plunger room 3 to be communicated with the fuel feed line, timing of opening and closing of the port 10*a* by the lead edge 2*a* of the plunger 2 can be varied by rotating the plunger 2 by means of the rack-pinion mechanism. The discharge of fuel ends at the top dead center of the plunger 2 with the port 10*a* being closed, and the port 10*a* remains closed in the down stroke of the plunger 2 from the top dead center for a period of crankshaft rotation angle of $\Delta\theta$ until the plunger 2 moves down to a position at which the port 10*a* begins to be opened by the lead edge 2*a* of the plunger 2 at crank angle $\theta_3$ to be communicated with the fuel feed pipe 201, so the plunger room 3 is communicated with the fuel feed pipe 201 in a state pressure in the plunger room 3 is reduced to lower than that in the fuel feed/spill passage. Therefore, occurrence of spill of high pressure fuel in the plunger room 3 through the port 10*a* at high speed, which occurs in an apparatus of prior art as shown in FIG. 5, can be evaded.

As a result, occurrence of cavitation erosion at the inlet/spill port 10*a* and in the fuel feed pipe 201 of the high pressure pump 20 can be prevented and high durability can be attained even in the case of a high pressure fuel pump increased largely in capacity.

Further, as the plunger room 3 is communicated with the feed pipe 201 in a state of pressure in the plunger room 3 is same as or lower than that in the fuel feed/spill passage (inlet/spill port 10*a* and fuel feed pipe 201), pressure pulsation in the fuel feed/spill passage due to back-flow of high pressure fuel does not occur, and problems such as fuel leak and so on due to pressure pulsation does not occur.

Furthermore, as the plunger 2 moves down from its top dead center while the inlet/spill port 10*a* remains closed, the plunger 2 moves down receiving pressure in the plunger room 20, so a part of energy used to drive the high pressure pump can be recovered.

Furthermore, as high pressure fuel does not spill through the inlet/spill port 10*a* to the fuel feed passage connecting to the fuel feed pump when the port 10*a* is opened by the leading edge 2*a* of the plunger 2, and it is not necessary as is in the case of the conventional high pressure pump to send spilled fuel again to the plunger room, so the fuel feed pump 18 for supplying fuel to the plunger room 3 can be small sized, and energy required to drive the fuel feed pump 18 can be reduced as compared with the apparatus of prior art.

According to the present invention, the electromagnetic valve is closed until the plunger of the high pressure fuel pump reaches the top dead center in its up stroke to discharge fuel, the electromagnetic valve is kept closed in the down stroke of the plunger until when pressure in the plunger room reduces, then the electromagnetic valve is opened to allow the plunger room to be communicated with the fuel feed/spill passage; or the plunger is formed to have a leading edge, by which the inlet/spill port of the plunger barrel is closed at a crank angle in the up stroke of the plunger to discharge fuel and opened in the down stroke thereof at a crank angle to allow the plunger room to be communicated with a fuel feed/spill passage, so the plunger room is communicated with the fuel feed/spill passage when pressure in the plunger room decreased to a level equal to or lower than that in the fuel feed/spill passage, resulting in that the occurrence of rapid backflow of high pressure fuel remaining in the plunger room to the fuel feed/spill passage at high speed, which occurs in an apparatus of prior art, can be evaded.

Accordingly, as occurrence of breakaway of flow and formation of eddies when high pressure fuel back flows from the plunger room to the low pressure side when the inlet passage 20*b* is opened can be evaded, occurrence of cavitation erosion in parts around the inlet port of the plunger and inlet passage can be prevented, and high durability can be attained even in the case of a high pressure fuel pump increased largely in capacity.

The invention claimed is:

1. A fuel injection apparatus for engines, the apparatus comprising a controller that controls fuel being supplied to and discharged from a plurality of high pressure fuel pumps and a common rail connected to the high pressure fuel pumps to receive pressurized fuel discharged from the high pressure fuel pumps and to inject the fuel into an engine through injection valves between the common rail and the engine, each high pressure fuel pump including:

a plunger barrel with a plunger room having a single fuel passage that provides the only connection between the plunger room and a fuel line, the single fuel passage having an electromagnetic valve that must be open to permit fuel to pass between the plunger room and the fuel line such that the electromagnetic valve prevents any fuel from passing between the plunger room and the fuel line when the electromagnetic valve is closed;

a plunger driven by a fuel cam to reciprocate in the plunger barrel; and a discharge passage that discharges fuel compressed by the plunger being driven by the fuel cam in a compression stroke to the common rail from the plunger room when a predetermined fuel pressure inside the plunger room is reached, wherein the controller controls the closing of the electromagnetic valve in the single fuel passage to occur during the compression stroke of the plunger and keeps the electromagnetic valve in the single passage closed to prevent any fuel from passing between the plunger room and the fuel line for a period after the plunger has completed the compression stroke and has entered into a decompression stroke that moves the plunger in a direction opposite to that moved during the compression stroke, then the controller opens the electromagnetic valve to allow the plunger room to be communicated with the fuel line through the single fuel passage.

2. The fuel injection apparatus as claimed in claim 1, wherein a common rail pressure sensor is provided to detect increasing pressure in the common rail, and said controller delays opening said electromagnetic valve during the decompression stroke of the plunger based on the pressure detected by the common rail pressure sensor.

3. A method of operating a fuel injection apparatus for engines, the apparatus comprising a plurality of high pressure fuel pumps, each high pressure fuel pump having a plunger barrel with a plunger room having only a single fuel passage connected between the plunger room and a fuel line, the single fuel passage having an electromagnetic valve that opens the single fuel passage when the electromagnetic valve is open and that closes the single fuel passage when the electromagnetic valve is closed, the method comprising:

supplying fuel to the plunger room solely through the single fuel passage thereof connected to the fuel supply line while keeping the electromagnetic valve therein open;

closing the electromagnetic valve in the single fuel passage so that the fuel supplied to the plunger room in the supplying step is compressed by a plunger driven by a fuel cam in a fuel compression stroke direction in the plunger room;

discharging the compressed fuel to a common rail when the compressed fuel reaches a predetermined high pressure;

injecting the fuel accumulated in the common rail into engine cylinders using injection valves at controlled timing;

keeping the electromagnetic valve closed during a decompression stroke of the plunger in which the plunger driven by the fuel cam moves in a decompression direction in the plunger room that is opposite to the compression direction until a particular pressure condition is met; and then opening the associated electromagnetic valve to allow the associated plunger room to be communicated with the fuel supply line through the single fuel passage after the particular pressure condition is met.

4. A fuel injection apparatus for engines, the apparatus comprising a plurality of high pressure fuel pumps, in each of which fuel supplied to a plunger room is compressed by a plunger driven by a fuel cam to reciprocate in a plunger barrel, the compressed fuel is discharged to a common rail, and high pressure fuel accumulated in the common rail is injected into engine cylinders by injection valves at controlled timing, wherein said plunger has a lead edge by which a single inlet/spill port of the plunger barrel that provides the only passage from the plunger room to a fuel line is closed in an up stroke of the plunger to allow fuel in the plunger room to be discharged until the plunger reaches its top dead center and the single inlet/spill port is opened in a down stroke of the plunger to allow the plunger room to be communicated with the fuel line.

5. A fuel injection apparatus as claimed in claim 4, wherein are provided a rack-pinion mechanism for rotating the plungers by sliding the rack, a rack drive device for sliding the rack, a common rail pressure sensor for detecting pressure in the common rail and inputting the detected pressure to said rack drive device, and a controller to allow the rack drive device to slide the rack to rotate the plungers based on the detected pressure so that timing of opening of the inlet/spill port by each of the plungers in down-stroke thereof is retarded as pressure in the common rail increases.

6. The fuel injection apparatus as claimed in claim 1, wherein said controller controls the electromagnetic valve to be open during the decompression stroke of the plunger at least until pressure in the plunger room is equal to or lower than pressure in the fuel line.

* * * * *